United States Patent [19]

McBride

[11] 4,428,033

[45] Jan. 24, 1984

[54] FLASHLIGHT HAVING TEST LEADS AND A SECOND, REMOTE, MAGNETICALLY ATTACHABLE ROTATABLE LAMP

[76] Inventor: Scott T. McBride, 559 Chestnut Street, P.O. Westwood, N.J. 07675

[21] Appl. No.: 398,388

[22] Filed: Jul. 14, 1982

[51] Int. Cl.[3] ..... F21L 7/00

[52] U.S. Cl. ..... 362/183; 324/53; 362/184; 362/205; 362/253; 362/295; 362/396; 362/398

[58] Field of Search ..... 324/53, 183, 184, 205, 324/295, 396, 398, 253

[56] References Cited

U.S. PATENT DOCUMENTS

| | | | |
|---|---|---|---|
| 2,550,233 | 4/1951 | Duncan | 362/205 |
| 3,634,680 | 1/1972 | Myrah | 362/184 |

*Primary Examiner*—Stephen J. Lechert, Jr.
*Attorney, Agent, or Firm*—Ralph R. Roberts

[57] ABSTRACT

This invention provides a flashlight of conventional use that has a socket at its rear end. A plug and flexible conductor assembly is inserted into this socket and carries the battery power from the conventional flashlight to an auxiliary light. This auxiliary light consists of a bulb carried in a housing having a lens, reflector, bulb socket and connecting means for the flexible conductor assembly. This auxiliary housing is pivotally mounted on a bracket attached to a permanent magnet. When magnetic attachment of this auxiliary light is not possible an auxiliary member containing a metal plate and a suction cup is provided. A hook is also disclosed when and where rungs, such as on a ladder, are available. A test probe assembly is shown in two embodiments. In the first embodiment a plug is inserted in the flashlight socket and continuity is indicated by the lighting of the bulb in the flashlight. In the second embodiment a flexible lead system employing male and female connectors is shown that is interposed between the flashlight case and auxiliary housing and the auxiliary bulb is lighted to indicate continuity. Each test probe provides sharpened probe ends that are used to test for continuity in sheathed conductors. This invention enables a mechanic to position each light to obtain the maximum illumination possible. The conventional flashlight may be placed where convenient and the auxiliary light may be magnetically or otherwise attached and rotated three hundred sixty degrees so as to shine in any direction for the best possible illumination. This placement enables the mechanic to use both hands for manipulating his tools or doing whatever task necessary. Each light can be used simultaneously or only one at a time. This invention is easy to construct, use and convenient to carry.

11 Claims, 8 Drawing Figures

FLASHLIGHT HAVING TEST LEADS AND A SECOND, REMOTE, MAGNETICALLY ATTACHABLE ROTATABLE LAMP

BACKGROUND OF THE INVENTION

1. Field of the Invention

With reference to the classification of art as established in and by the United States Patent Office this invention is believed to be classified in the general class entitled "Electrical Measuring and Testing" (Class 324) and in the subclass therein entitled, "flashlight-tester type" (Subclass 53).

2. Description of the Prior Art

Flashlights and testing apparatus used therewith are well known and several U.S. patents have disclosed and shown hand-held flashlights with testing capabilities. Among these patents are U.S. Pat. No. 1,121,293 as issued to SACHS on Dec. 15, 1914; U.S. Pat. No. 2,231,660 as issued to CARLOTTI et al as issued Feb. 11, 1941; U.S. Pat. No. 2,687,508 as issued to NOYES on Aug. 24, 1954; U.S. Pat. No. 2,703,385 as issued to GURD on Mar. 1, 1955; U.S. Pat. No. 2,899,638 as issued to OLSON on Aug. 11, 1959; U.S. Pat. No. 2,902,643 as issued to PASQUALE on Sept. 1, 1959; U.S. Pat. No. 2,946,003 as issued to PRYER on July 19, 1060; U.S. Pat. No. 3,047,798 as issued to WINSLETT on July 31, 1962; U.S. Pat. No. 3,393,312 as issued to DAHL on July 16, 1968; U.S. Pat. No. 3,973,193 as issued to HAYES on Aug. 3, 1976, and U.S. Pat. No. 4,021,732 as issued to METCALF on May 3, 1977.

Magnetic force for attaching a flashlight body is shown in U.S. Pat. No. 1,121,293 and U.S. Pat. No. 3,393,312. Circuit testing using flexible leads are shown in U.S. Pat. Nos. 2,231,660; 2,703,385; 2,899,638; 2,902,643; 2,946,003; 3,973,193 and 4,021,732. A plug attached lead is shown in U.S. Pat. No. 3,047,798. The circuit testing device of U.S. Pat. No. 2,687,508 suggests a probe-like member that is inserted into an aperture provided in the flashlight case.

The several patents above noted do not provide or suggest applicant's plug-in extension with a flexible lead that carries electrical energy from the battery to a separate light bulb which is then illuminated. This bulb is carried in a pivoted housing mounted on a magnetic support member. This magnetic support member, when the portion to which it is to be attached is nonmagnetic, utilizes a separate plate which carries both a hook and a suction cup. An auxiliary test lead is adapted to be interposed in the flexible lead line to provide a continuity test for open lines or fuses. The flashlight itself may be selectively turned on or off by an associated switch in the normal manner. The circuit and socket may have means for connecting the light and with another arrangement of leads the plug may connect to the socket to provide a continuity tester with the bulb in the flashlight illuminated when the circuit or fuse is intact.

SUMMARY OF THE INVENTION

This invention may be summarized, at least in part, with reference to its objects. It is an object of this invention to provide, and it does provide, a flashlight with a switch adapted to energize the bulb in a conventional manner. This holder or case is also provided at its rear end with a plug receptacle adapted for placing the plug in a connected condition to carry battery current through flexible conductors to a separate bulb carried in an auxiliary housing pivotally mounted on a magnetic base. The circuit and socket are arranged to provide current through the flexible leads to the light in the separate holder. Another plug is adapted for insertion into this same socket and two flexible leads extend to probe ends which are used in a continuity tester to illuminate the flashlight bulb to indicate continuity or a good fuse. A conductivity tester may be interposed in the flexible lead array to utilize the bulb in the remote housing to indicate the satisfactory continuity of conductors or a fuse. The flashlight or the auxiliary light may be used as a continuity tester, whichever is more convenient for the user.

It is a further object of this invention to provide, and it does provide, a flashlight and case having a manipulated switch for turning the light on and off in the conventional manner. This flashlight case has a plug receptacle adapted to receive a plug and with the plug connected to a flexible lead and at its other end connected to a bulb in another auxiliary housing which is pivotally carried by a magnetic base or means. A circuit or continuity tester is provided and is used with the auxiliary light source and with leads or probes to provide testing. A metal plate means attachable to the magnetic unit by the magnetic force contains a hook and/or a suction cup for attaching the auxiliary unit to a non-magnetic surface.

It is still a further object of this invention to provide, and it does provide, an auxiliary light which is actuated by plugging in the flexible lead and with the auxiliary housing carried on a bracket so as to be pivotally mounted on this bracket and this bracket carried in a swivel manner on a magnetic member so as to provide a three hundred sixty degree placement of the light to direct the beam in any and all selected directions.

In brief, the flashlight of this invention contemplates a plastic case and switch of conventional construction. This flashlight case also has a plug-in socket at its rear end adapted to receive and retain a plug and connected flexible leads. This plug-in socket is shown with two circuits and in one arrangement the socket is adapted to receive two different plugs, each of which are connected to two flexible conductors. With a first plug-in socket the flexible leads carry battery current to an auxiliary light source pivotally carried by magnetic means. Another plug is also adapted to be inserted in this same socket and two flexible conductors each lead to probe ends and the bulb in the flashlight indicates continuity or a good fuse. Another circuit uses a separate test probe which is carried by an auxiliary wire or conductor means to cause the auxiliary light to be illuminated when continuity is present. A separate plate having a suction cup and hook is adapted to be used with the magnet when the auxiliary light is to be attached to a non-magnetic surface. This auxiliary light is mountable on any surface either by the magnetic attraction to a metal surface or by using the suction cup or hook. The secured auxiliary lamp is positioned by the user to direct the illumination toward any selected area with a three hundred sixty degree placement. Thus, by pivoting and swivel means illumination of any dark area is possible. Electricans working in dark panel boxes, mechanics working on cars or in dark boat hatches, etc. now have the light necessary to do this required work with the advantage of having both hands free since it is not necessary to hold this flashlight.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen preferred embodiments of the improved flashlight having test leads and a second remote, magnetically attachable rotatable lamp.as adopted for use as a conventional flashlight and showing a preferred means for attaching said remote light and probes. These specific embodiments have been chosen for the purposes of illustration and description as shown in the accompanying drawings wherein:

BRIEF DESCRIPTION OF THE DRAWING

In the following description and in the claims various details are identified by specific names for convenience. These names are intended to be generic in their application. Corresponding reference characters refer to like members throughout the several figures of the drawings.

The drawings accompanying, and forming part of, this specification disclose details of construction for the purpose of explanation but structural details may be modified without departure from the concept and principles of the invention and the invention may be incorporated in other structural forms than shown.

Figure 1:
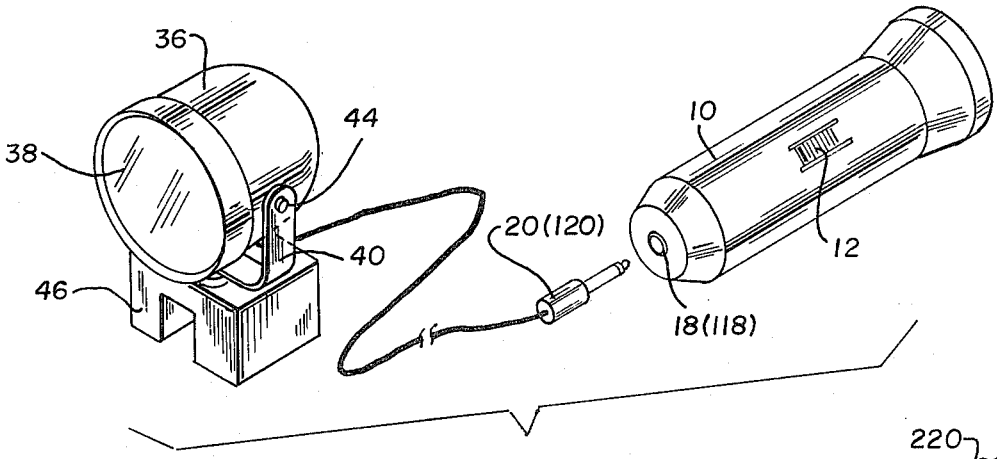
FIG. 1 represents an expanded isometric view, partly diagrammatic of a flashlight, flexible conductor with a plug connector, and an auxiliary light pivotally carried by and on a permanent magnet base member.
Figure 2:
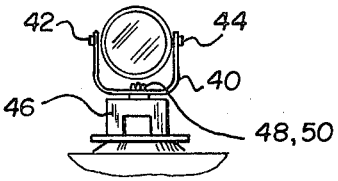
FIG. 2 represents a fragmentary and diagrammatic end view of the pivotally mounted auxiliary light and an additional metal plate having a suction cup for mounting this auxiliary member on a nonmagnetic surface.

DESCRIPTION OF THE EMBODIMENT OF FIGS. 1 and 2

Referring now to the drawings and the preferred embodiment as shown in FIGS. 1 and 2, a flashlight case 10 is of conventional configuration. This case is usually of molded plastic with insulating properties. Such a case is also less expensive to produce in todays market but this is not to preclude the making of a case of metal where and when the usual insulation is provided. An "off" and "on" switch 12 conventionally causes a bulb 14 to be energized by a battery source 16. A socket 18 or 118 is adapted to receive one of a plug 20 or 120, said plug is shaped as a common banana plug. This plug is connected to two flexible conductors which are identified as 22, 23, 24, 122 and 123. These leads are separately identified as to their use and in circuits to be later described.

The socket carried by the flashlight case is novel since the contacts in known probe testing arrangements are only disposed to energize the flashlight bulb when continuity is present. The presently known apparatus does not provide a flexible connection to an auxiliary light, in fact no auxiliary light is mentioned or suggested. In the present invention two circuits are shown and two socket arrangements are contemplated. In the preferred embodiment the plug 20 is mounted in the socket 18 and is connected to flexible conductors 22, 23 or 24. Conductors 22, 23 or 24 are connected at one end to the plug 20 which causes contacts 26, 28 or 29 disposed in the socket 18 to be engaged by the entering end 30 and shank 32 or 33 of the plug 20 to be electrically connected to an auxiliary lamp or bulb 34 carried in and by a remote housing 36. A conventional transparent lens member 38 and reflector not identified is provided in this auxiliary member. Bracket 40 which is shown as U-shaped in FIG. 2 carries this housing 36 and pivotal posts or bolts 42 and 44 carry this housing in said bracket. A permanent magnet 46 is retained by a bolt and nut 48 and 50 to the midportion of the bracket 36.

The socket 18 of FIG. 1 may be the socket as used in FIGS. 4, 5 and 6 and socket 118 of FIG. 7, to be more fully described hereinafter. The plug 20 or 120 is made to suit the circuit used. It is contemplated that when and as the plug is inserted in the socket, electrical current is carried by two flexible conductors to the remote and auxiliary lamp for illumination thereof. When the test probe is to be used as in FIG. 6 the flashlight bulb is used as an indicating device with illumination of bulb 14 indicating continuity.

Use and Operation of the Apparatus of FIGS. 1 and 2

Figure 3:
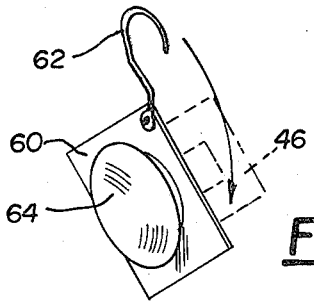
FIG. 3 represents an isometric view, partly diagrammatic and in a slightly enlarged scale and showing the plate assembly of FIG. 2 and hook as used for securing the auxiliary light to a non-magnetic surface.

Conventional flashlights, in many instances, cannot be effectively used when and where a two handed effort must be expended or is otherwise required. Often more than one light is desired or required and a precise positioning of a light means or source may require a lamp remote from a lamp source of A.C. current. The present flashlight and auxiliary lamp of this invention provides an apparatus in which a case 10 utilizes a switch 12 and batteries 16 to illuminate bulb 14 in a conventional manner. Remote illumination is provided by said flashlight which provides an auxiliary lamp 34 in a housing 36 which is usually illuminated when connected. Positioning of this auxiliary light and directing this illumination in a desired manner is easily achieved by using the pivoted support and permanent magnet 46 which allows mounting on a magnetic metal surface. When a metal surface is not available or inconvenient auxiliary means as shown in FIG. 3 is available and used. The flashlight as provided in case 10 may or may not be turned on since each lamp may be illuminated independently of the other but the placing of plug 20 in the socket 18 is required to energize the bulb or lamp 34.

Magnetic Support as in FIGS. 2 and 3

A permanent magnet 46 is used when the surface is of a magnetically attractive metal. When such a surface is not available other means are required. The magnetic attractive member as provided by the permanent magnet 46 is used with an auxiliary metal plate 60 which is sized to be attracted to this magnet 46. As depicted, this plate is more-or-less square and on one corner is pivotally retained a secured hook 62. This hook is swung in-and-out of use and is employed usually when ladders of wood, aluminum or magnesium are present. This hook 62 allows the auxiliary lamp 34 and housing 36 to be employed when and where desired. A suction cup 64 is shown as secured to and mounted on this plate 60 and is a means for securing and retaining said auxiliary light when a nonmagnetic but smooth flat surface is present. This suction cup is conventionally made of a resilient material such as rubber or rubber-like material. More than one suction cup may be mounted on plate 60 if and when desired and the number of said cups are merely a matter of selection.

Circuits of FIGS. 4, 5, 6 and 7

Figure 4:
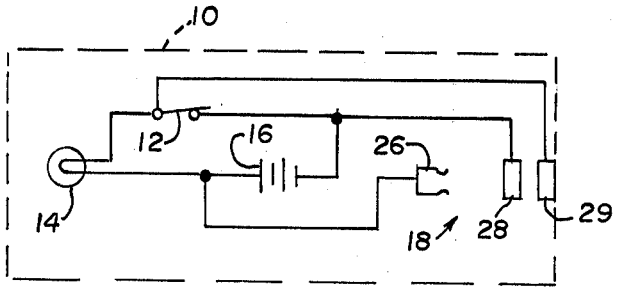
FIG. 4 represents a preferred circuit diagram of the flashlight and circuit therein and connection to a socket provided within the flashlight case.
Figure 5:
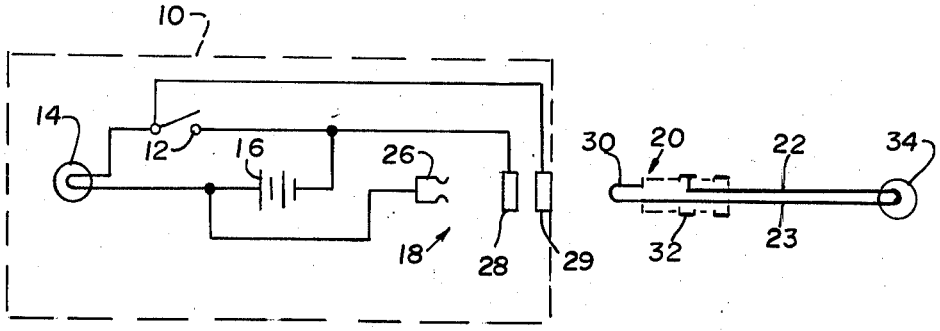
FIG. 5 represents the circuit diagram of FIG. 4 and showing a plug having two flexible leads to carry current to an auxiliary bulb.
Figure 6:
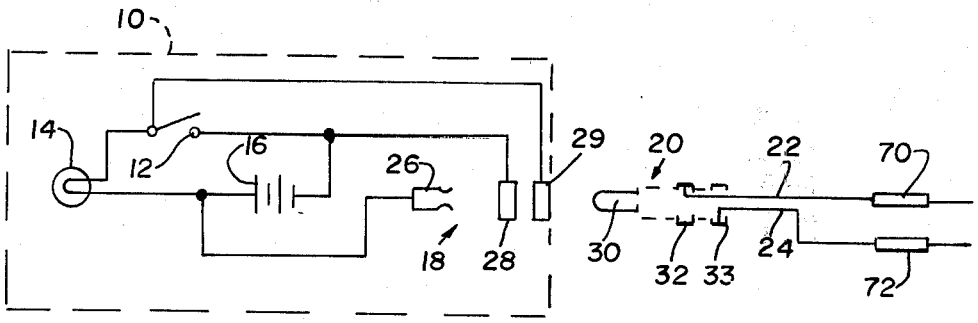
FIG. 6 represents the circuit diagram of FIG. 4 and showing a plug having two flexible leads connected to test probes.

The several circuits shown in FIGS. 4, 5, 6 and 7 represent only two arrangements. In FIGS. 4, 5 and 6 the socket 18 is electrically connected to three connectors while the circuit of FIG. 7 contemplates that socket 118 is connected to only two connectors leading to the battery. In both arrangements it is contemplated that auxiliary lamp or bulb 34 may be selectively connected with the auxiliary lamp mounted in the remote housing 36.

In all circuits it is contemplated that there is provided a case 10; a switch 12; a lamp or bulb 14 in the flashlight; a battery or batteries 16 and a socket 18 or 118. A plug 20 or 120 may be used and flexible conductors 22, 23, 24 and 112 or 123 are connected to these plugs. Only two flexible conductors are contemplated to be used with any plug. In all but the circuit arrangement of FIG. 6 the auxiliary lamp or bulb 34 is connected to the battery source 16 and is illuminated when said connection is made.

The circuit of FIG. 4 is repeated in FIGS. 5 and 6 which show the plug 20 for insertion in the socket 18. In FIG. 4, switch 12 is shown in the closed condition or position to cause bulb 14 to be illuminated by battery 16. Since or as plug 20 is not inserted into socket 18 the flashlight operates in the usual and customary manner.

In FIG. 5 switch 12 is shown in the open condition whereat bulb 14 is not illuminated. Plug 20 is inserted into socket 18 whereat the plug tip end 30 engages the socket contacts 26 to carry current from battery 16 to these contacts and through tip end 30 to conductor 23 and to one side of lamp 34. The midportion 32 of plug 20 engages contact 28 in the socket and through flexible conductor 22 carries electrical current from the battery to the other side of lamp 34. When and if the lamp 14 is also to be illuminated the switch 12 is closed.

In FIG. 6 the circuit of FIG. 4 is still used and as depicted switch 12 is open and bulb 14 is not illuminated. A plug 20 is inserted in socket 18 and the midportion of the stem of the plug which is attached to conductor 32 is engaged by the socket contact portion 28 to flexible conductor 22 and to probe end 70. This plug has its rear stem portion identified as 32 and is engaged by the contact 29 in the socket 18 to carry negative electrical current through flexible lead 24 to another probe end 72. When probe end 70 and 72 are touched or make a circuit through a good fuse or conductor the established path causes a ground or negative connection to the battery bypassing switch 12 and to one side of the bulb 14.

The circuit of FIG. 4 therewith provides a socket 18 in which one plug 20 may have conductors 22 and 23 providing electrical current to the bulb 34. With a plug 20 of FIG. 5 removed from the socket 18 another and like plug 20 is inserted in this socket. This plug 20 is connected as in FIG. 6 to provide for a continuity check.

Figure 7:
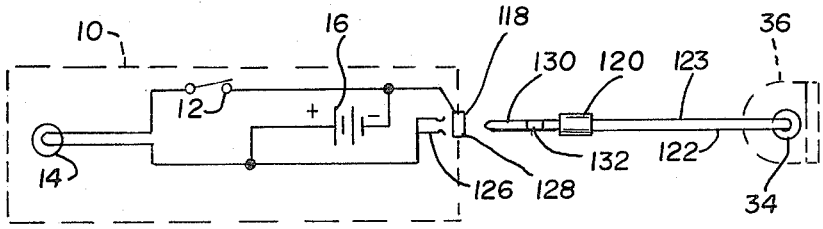
FIG. 7 represents an alternate and diagrammatic circuit of the flashlight and with the flexible leads connected by a plug to an auxiliary bulb.

In FIG. 7 the socket at the end of the flashlight is identified as 118 and the plug used and inserted thereinto is 120. Rather than a socket with three contacts as in FIGS. 4, 5 and 6, this circuit employs a socket with only two contacts. The inner contact is 126 and engages a tip end 130 of the plug. An outer ring or spring contact 128 engages a shank portion of the plug indentified as 132. In the engaged condition the inserted plug 120 carries electrical current from battery 16 to contacts 126 and 128 and from plug 120 through the tip 130 and shank 132 to and through the pair of flexible leads 122 and 123 to lamp 34. Switch 12 is closed when lamp 14 is to be actuated. The insertion of plug 120 in socket 118 causes the remote lamp 34 to be actuated.

Figure 8:
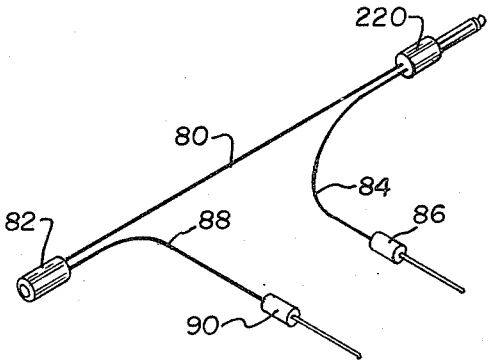
FIG. 8 represents an isometric view of a test lead assembly that is disposed to be interposed between the auxiliary lamp assembly and the socket in the flashlight.

Probe Embodiment as in FIG. 8

Referring next and finally to FIG. 8 and the probe arrangement provided therewith, it is to be noted that the assembly of FIG. 1 with the socket 118 of FIG. 7 may be used to confirm continuity as in FIG. 6. In this arrangement a plug 220 similar to 120 above identified is mounted in the socket 118. A flexible lead 80 extends from plug 220 to a connector socket 82 which is adapted to receive and retain plug 120. From plug 220 another flexible conductor 84 extends to a probe end 86 which is of conventional construction and use. From socket connector 82 a flexible lead 88 extends to another probe 90 similar to probe 86 and used therewith.

It is to be noted that the flashlight in this application anticipates the potential for use of an auxiliary lamp that is selectively positioned for directing the illumination toward and to the desired spot or position. When and where a continuity test is to be made either circuit of FIGS. 6 or 7 may be used. In FIG. 6 the lamp 14 is illuminated to show a positive test and in FIG. 7 the lamp 34 is illuminated to indicate a positive test. A permanent magnet is suggested for the magnetic member 46 in FIGS. 1, 2 and 3 as such magnets are inexpensive and do not require a source of electrical energy. This does not preclude a magnetic device that is not of a permanent magnet construction as long as the remote auxiliary lamp is contemplated to be easily secured without unwanted hinderances. Often the apparatus shown is used with and by a single mechanic who desires and needs dual illumination or remote illumination in relatively inaccessible areas. The above described apparatus provides such a tool.

It is to be noted that the embodiments shown allow the flashlight to be used in the usual manner and the sockets 18 or 118 include insulation means to prevent shorting of the battery. Switch 12 is selectively actuated to provide illumination of bulb 14. The remote lamp or bulb 34 is connected by flexible conductors to a removable plug 20 or 120, and provides illumination remote from the flashlight and irregardless of the actuation of switch 12. The use of a permanent magnet 46 is enhanced when a non-magnetic surface or condition is present by the accessory provided in FIG. 3.

Terms such as "left", "right", "up", "down", "bottom", "top", "front", "back", "in", "out" and the like are applicable to the embodiments shown and described in conjunction with the drawings. These terms are merely for the purposes of description and do not necessarily apply to the position in which the flashlight case, auxiliary lamp and probes may be constructed or used.

While a particular embodiment of the flashlight case, sockets and magnetically supported auxiliary lamp and an alternate embodiment has been shown and described it is to understood the invention is not limited thereto and protection is sought to the broadest extent the prior art allows.

I claim:

1. A flashlight characterized as having a socket means for selectively and removably supplying electrical energy to a remotely disposed and connected lamp and/or continuity tester, said flashlight including;

(a) a flashlight case of conventional configuration and having a switch on the exterior of said case for supplying and connecting battery power from an enclosed battery source to one side of a first bulb carried within said case, the other side of this first bulb connected to said battery source and actuated only by said switch;

(b) a socket disposed and carried by said case and electrically and independently connected to both poles of the battery source, said socket disposed in that end of the flashlight case opposite the end in which the first bulb is carried, this socket providing contact means within the socket and in mounted condition providing electrical contacting means within the flashlight case to provide electrical energy from both sides of the battery source and independent of other connecting means to the same battery source and so that said electrical contacting means is insulated from random exterior contact;

(c) a plug insertable in and removable from said socket and when inserted in said socket said inserted plug engaging the contacting means in the socket and supplying conducting means from both poles of said battery source and carrying this electrical battery power to a second bulb disposed remotely from said flashlight case and/or to a continuity tester;

(d) a pair of flexible conductors extending from said plug to either a remote housing and said second bulb therein or to a continuity tester or to an interposed conductor, the insertion of said plug in said socket effecting a conducting path to said battery source so as to light this second bulb, or through an interposed continuity tester and conductors, or to a continuity tester disposed to only illuminate the first bulb and absent actuation of switch when continuity is established, and (e) a magnetic device providing a base secured to a bracket which pivotally supports and retains said remote housing and the second bulb therein and maintains said housing in a selected adjusted position so that the lighted second bulb directs the light therefrom to a selected area.

2. A flashlight as in claim 1 in which the socket is connected to three portions of a circuit, the socket connected at a first portion to the positive pole of the battery source, a second portion to the negative side of the battery source which is also connected to a first side of the switch in the flashlight case and a third portion connected to the second or front side of the switch and to one side of the first lamp in the flashlight.

3. A flashlight as in claim 2 in which the plug mountable in said socket is connected at its front or entering end to a flexible conductor leading from the first portion and connected to the positive pole of the battery source and at its other end to the second lamp, and at the second portion another flexible conductor is connected to the plug and at its other end is connected to the other side of the second lamp.

4. A flashlight as in claim 2 in which the plug mountable in the socket is connected at said second portion to a flexible conductor and at the other end of said flexible conductor is connected to a test probe and this seated plug is conductively connected to one side of the battery and this plug connected at a third portion to a flexible conductor which is attached at its other end to a second test probe, with said third portion on the plug conductively connected to the other side of the switch and with the test probes and a positive conductivity being established the first lamp is lighted.

5. A flashlight as in claim 1 in which the socket in the case is provided with only two connections to said battery source, one connection to the positive side of the battery source and one connection to the negative side of the battery source and the plug that is insertable in said socket effectively conducts electric battery power by flexible conductors from said battery source to said second lamp.

6. A flashlight as in claim 5 in which there is interposed between the socket in the case and the plug a circuit test probe device that includes an auxiliary male plug adapted to be mounted in and retained in said socket in the case and from said auxiliary male plug there is one flexible conductor which extends to an auxiliary female socket adapted to receive the plug connected to said flexible conductor and second lamp, and a second flexible lead extending from and connected to said auxiliary male plug to a probe end, and from said auxiliary female socket there is connected a flexible conductor extending to another probe end, these probe ends when electrically connected to a conductor, fuse and/or the like determining continuity with a positive indication lighting the second lamp.

7. A flashlight as in claim 6 in which the plug socket is provided with a contact disposed to engage the tip end of the plug and with a ring or spring contact disposed to engage a shank portion of the plug.

8. A flashlight as in claim 1 in which there is also provided a metal plate adapted to be engaged by the magnetic device and when secured thereto to present at least one suction cup adapted to engage a relatively smooth surface and in mounted condition to retain the magnetic device of the remote lamp and housing.

9. A flashlight as in claim 1 in which the metal plate additionally has a hook pivotally secured thereto and providing therewith means to hang the magnetic device of the remote lamp and housing from a rung-like support such as on a ladder.

10. A flashlight as in claim 1 in which the flashlight case is of an insulating material such as plastic and the socket is positioned at the rear of said case.

11. A flashlight as in claim 1 in which the remote housing is also of insulated material and includes a lens, reflector, bulb socket and connecting means to said flexible conductors.

* * * * *